US006018542A

United States Patent [19]

Berger

[11] Patent Number: 6,018,542

[45] Date of Patent: Jan. 25, 2000

[54] SEALED ELECTRODE FEEDING ASSEMBLY

[75] Inventor: Douglas N. Berger, Kennewick, Wash.

[73] Assignee: Integrated Environmental Technologies, LLC, Richland, Wash.

[21] Appl. No.: 09/227,489

[22] Filed: Jan. 6, 1999

[51] Int. Cl.[7] ..... H05B 7/12

[52] U.S. Cl. ..... 373/95; 373/100

[58] Field of Search ..... 373/88, 91–95, 373/100–103, 51–55, 38

[56] References Cited

U.S. PATENT DOCUMENTS

| | | | |
|---|---|---|---|
| 3,379,816 | 4/1968 | Hozven | 373/95 |
| 4,216,347 | 8/1980 | Holtermann et al. | 373/95 |
| 4,238,634 | 12/1980 | Krogsrud | 373/95 |
| 4,357,485 | 11/1982 | Lamarque | 373/95 |
| 4,457,002 | 6/1984 | Mathgen et al. | 373/95 |
| 4,665,530 | 5/1987 | Corbethau | 373/92 |
| 4,736,384 | 4/1988 | Sakai et al. | 373/92 |
| 5,638,398 | 6/1997 | Ikitsu et al. | 373/92 |
| 5,666,891 | 9/1997 | Titus et al. | 110/250 |

*Primary Examiner*—Tu Ba Hoang
*Attorney, Agent, or Firm*—Douglas E. McKinley, Jr.

[57] ABSTRACT

An apparatus for feeding electrodes into a process chamber is disclosed. The apparatus is designed to maintain the atmosphere within the process chamber as separate from the atmosphere surrounding the process chamber. The apparatus has an air-tight tube having at least two internal sealing mechanisms, an outer sealing mechanism and an inner sealing mechanism, sealing mechanisms separated by an expandable section of the tube; penetration in the tube for the introduction of a purge gas in between the inner and outer sealing mechanisms; and an electrical contact for transmitting electrical power to the electrode.

5 Claims, 2 Drawing Sheets

SEALED ELECTRODE FEEDING ASSEMBLY

FIELD OF THE INVENTION

The present invention relates generally to an apparatus for automatically introducing electrodes into a process chamber. More specifically, the present invention relates an apparatus for automatically introducing electrodes into a process chamber wherein the atmosphere within the process chamber is kept separate from the atmosphere exterior to the process chamber.

BACKGROUND OF THE INVENTION

The preferred method of treating a great variety of hazardous and other wastes is vitrification. Materials are vitrified when they are heated to high temperatures, and if necessary combined with glass forming materials, to form the materials into a stable, leach resistant glass. Heating these materials may be performed by a variety of methods. For example, it is common to place electrodes (hereinafter joule heating electrodes) in direct contact with the waste materials, and to then pass a current through the materials. In this manner, electrical energy passing between the electrodes is converted into heat due to the resistive properties of the waste materials, thereby promoting vitrification of the waste materials. In another arrangement, a high electrical potential is generated across a pair of electrodes, or a single electrode and the waste material (hereinafter arc electrodes), to create an ionized gas, or a plasma. A plasma generated in this manner will exhibit high temperatures, ranging from approximately 3,500° C. to over 10,000° C. Heat from the plasma is thus radiated to the surrounding waste material.

In U.S. Pat. No. 5,666,891, titled "Arc Plasma-Melter Electro Conversion System for Waste Treatment and Resource Recovery" to Titus et al. and incorporated herein by reference, a variety of particularly useful configurations are shown wherein joule electrodes are used in systems in various combinations with arc electrodes. In these arrangements, organic compounds contained in the waste are destroyed by pyrolysis, wherein the high temperatures of the plasma break the chemical bonds of the organic molecules. By introducing steam to the process chamber, these pyrolyzed organic constituents are converted into a clean burning fuel consisting primarily of CO, $CO_2$ and $H_2$ through a steam reforming reaction. Other constituents of the waste, which are able to withstand the high temperatures without becoming volatilized, are made to form into a molten state which then cools to form a stable glass. By carefully controlling the vitrification process, the resulting vitrified glass may be made to exhibit great stability against chemical and environmental attack, with a high resistance to leaching of the hazardous components bound up within the glass. In this manner, vitrification may be utilized to convert waste materials into a high quality fuel gas and a stable, environmentally benign, glass.

Because of the volatile nature of the clean burning fuels generated by the pyrolysis/steam reforming/vitrification process, it is desirable that the region wherein heating takes place and the fuel gasses are generated be kept separated from the ambient atmosphere. At the same time, as materials are vitrified, both the joule heating electrodes and the arc electrodes are consumed. Therefore, prior art processes have heated the waste materials in process chambers designed to keep the gaseous products of the process separate from the ambient atmosphere. Electrodes are introduced through penetrations in the process chamber. When the electrodes are consumed, the process is halted to allow the electrodes to be replaced. Stopping the vitrification process is undesirable because it lowers the processing throughput and may allow the processing chamber to cool which can cause damage or degradation to the process chamber. These and other drawbacks of the prior art have created a need for improved apparatus allowing the introduction of electrodes into a process chamber while maintaining the atmosphere within the process chamber as separate from the atmosphere exterior to the process chamber.

SUMMARY OF THE INVENTION

Accordingly, the present invention is an apparatus for automatically introducing electrodes into a process chamber wherein the atmosphere within the process chamber is kept separate from the atmosphere exterior to the process chamber. The present invention consists of an air-tight tube having at least two internal sealing mechanisms, an outer sealing mechanism and an inner sealing mechanism, separated by an expandable, sealed section within the tube. Preferably, the sealing mechanisms are constructed of inflatable bladders, which circumscribe the electrode, and the expandable section of the tube is constructed of a bellows. In between the inner and outer sealing mechanisms there is a penetration in the tube for the introduction of a purge gas. At one end of the tube, nearer to the outer sealing mechanism, electrodes are introduced into the tube. The other end of the tube is an electrical contact for passing electrical power to the electrode. Preferably, this contact is a water cooled collar through which the electrode passes. The electrical contact is isolated from the tube by insulators to prevent electrical power from the electrical contact from passing to the tube. Just past the electrical contact, the tube is attached about a penetration in the process chamber, allowing the electrodes to pass through the tube and into the chamber.

The electrode is first inserted into the tube such that the electrode extends completely through the tube, (the inner and outer sealing mechanisms, the electrical contact, and the penetration into the process chamber), to the location within the process chamber desired by the user. The interior and exterior sealing mechanisms are then sealed about the electrode, forming an airtight seal separating the exterior atmosphere from the process chamber atmosphere and the electrode may then be operated by delivering power to the electrode through the electrical contact. As the electrode is consumed within the process chamber, the inner and outer sealing mechanisms are then made to work in concert to draw the electrode into the process chamber while maintaining the integrity of the process chamber atmosphere. First, the exterior sealing mechanism is relaxed, or unsealed, allowing it to move freely along the length of the electrode. While the outer sealing mechanism is relaxed, the integrity of the atmosphere in the process chamber is maintained by the inner sealing mechanism, which remains sealed. Actuators then expand the expandable section of the tube, such as a bellows, sliding the outer sealing mechanism along the length of the electrode. During this process, an inert purge gas is introduced through the penetration in the tube, purging the region between the inner and outer sealing mechanisms and preventing any air from entering this region. The outer sealing mechanism is then sealed about the electrode, forming an airtight seal and again insuring the integrity of the process chamber atmosphere. Protected from the outside atmosphere by the now sealed outer electrode, the inner sealing mechanism is then relaxed, or unsealed, allowing the inner sealing mechanism to move freely along the length of the electrode. The actuators then contract the expandable section of the tube, forcing the electrode through the electrical contact, through the penetration in the process chamber, and into the process chamber to the location desired by the user. At the end of the actuator stroke, the inner sealing mechanism again seals about the electrode, and the process is ready to be repeated. By utilizing electrodes which are configured to be connected end to end, (for example by machining the electrodes to have threaded ends, with a male joint at one end and a female joint at the other end), the electrode may be extended by the addition of additional sections of electrode. In this manner, as the electrode is consumed, it may be extended to allow an infinite length of electrode to be fed into the process chamber with no interruption in processing.

OBJECTS

Accordingly, it is an object of the present invention to provide an apparatus for introducing electrodes into a process chamber wherein the atmosphere within the process chamber is kept separate from the atmosphere exterior to the process chamber.

It is a further object of the present invention to provide an apparatus for automatically introducing electrodes into a process chamber wherein the atmosphere within the process chamber is kept separate from the atmosphere exterior to the process chamber.

It is a further object of the present invention to provide an apparatus for feeding electrodes into a process chamber which maintains the atmosphere within the process chamber as separate from the atmosphere surrounding the process chamber having an airtight tube having at least two internal sealing mechanisms, an outer sealing mechanism and an inner sealing mechanism, said sealing mechanisms separated by an expandable section of the tube; penetration in the tube for the introduction of a purge gas in between the inner and outer sealing mechanisms; and an electrical contact for transmitting electrical power to the electrode.

It is a further object of the present invention to provide a water cooled collar located within the tube through which the electrode is inserted as an electrical contact.

It is a further object of the present invention to provide the electrical contact isolated from the tube by insulators to prevent electrical power from the electrical contact from passing to the tube.

It is a further object of the present invention to provide inflatable bladders as the internal sealing mechanisms.

It is a further object of the present invention to provide an actuator attached to the tube at locations on either side of the expandable section of the tube to allow the apparatus to be operated automatically.

DESCRIPTION OF THE PREFERRED EMBODIMENT(S)

Figure 1:
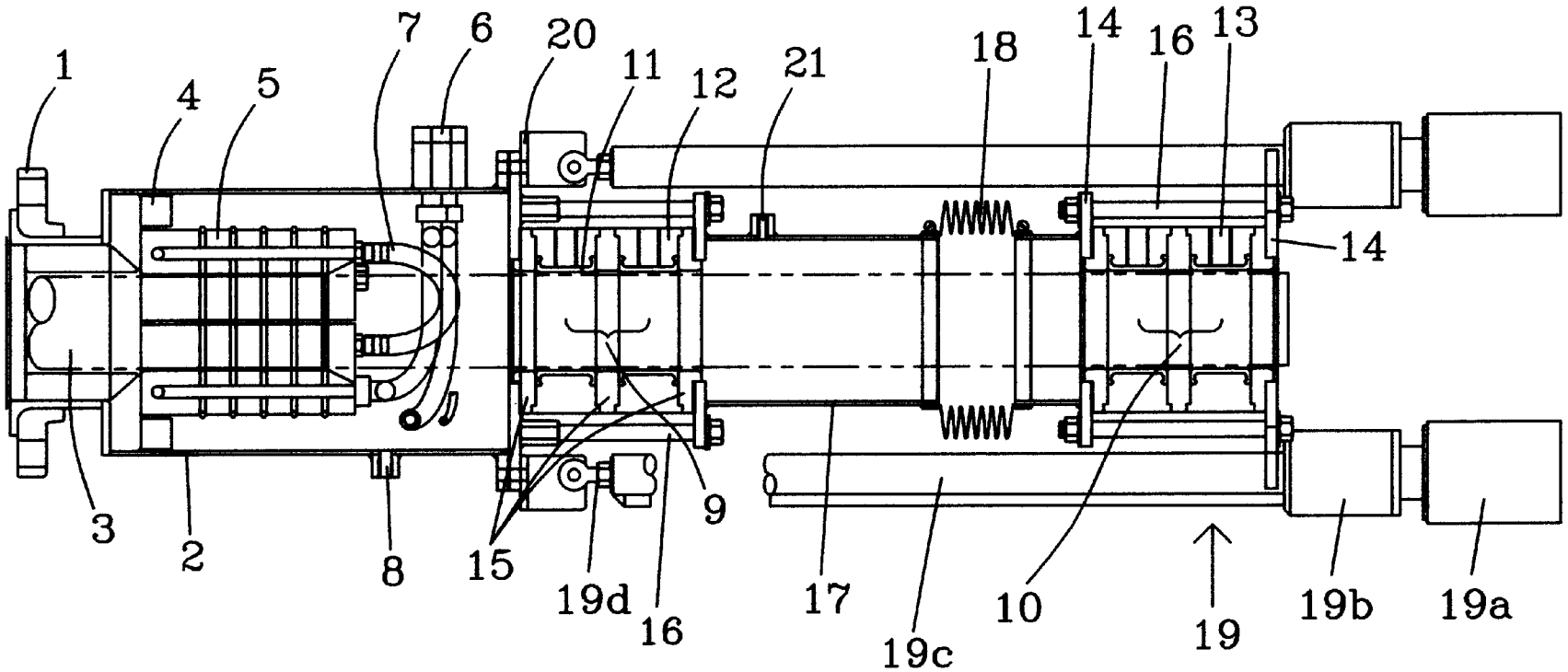
FIG. 1 is a cut away, schematic view of a first prototype built to demonstrate a preferred embodiment of the present invention.

A prototype sealed electrode feeding assembly was constructed to demonstrate the advantages of the present invention. As shown in the cut away view of the prototype device in FIG. 1., at the end of the apparatus a mounting flange 1 is attached to a cooling and electrical contact assembly housing 2. The mounting flange 1 is constructed to allow the apparatus to be attached about a penetration in a process chamber or other vessel (not shown) through which electrodes 3 are introduced into the process chamber or other vessel. Isolating collar 4 is provided interior to electrical contact assembly housing 2 which holds in place electrical contact collar 5. Isolating collar 4 also prevents power from electrical contact collar 5 from being passed to electrical contact assembly housing 2. Power and cooling water are provided to electrical contact collar 5 through power and cooling water port 6 which is in communication with electrical contact collar 5 via hose 7 and a wire connection (not shown). A secondary gas purge port 8 is provided to allow the introduction of an inert gas, preferably nitrogen, into the apparatus to flush air from the apparatus. Electrode 3 is inserted through electrical contact collar 5, which passes electrical power to the electrode 3. Cooling water from power and cooling water port 6 prevents overheating of electrical contact collar 5 allowing continuous, high powered operation.

The inner 9 and outer 10 internal sealing mechanisms are each assembled of two flexible bladders 11 purchased from the Pressray Corp. of Pawling N.Y. Bladders 11 surround electrode 3 and are fitted over insulating bladder supports 12. Passage of gas through bladder inlet 13 allows the bladders to be inflated and deflated. When inflated, bladders 11 tighten around electrode 3 forming an airtight seal. When deflated, bladders 11 loosen from electrode 3 allowing the electrode 3 to slide through the bladder 11. Within the inner 9 and outer 10 internal sealing mechanisms, isolating bladder supports 12 are separated from one and another and bladder assembly flanges 14 by isolators 15. The inner 9 and outer 10 internal sealing mechanisms are each held together by screws 16 threaded through the bladder assembly flanges 14. Bladder assembly flanges 14 also connect electrical contact assembly housing 2 with electrode housing 17. Electrode housing 17 is divided by bellows 18 which allows the inner 9 and outer 10 internal sealing mechanisms to move independently of one and another.

As set forth in the summary of the invention, the prototype of the sealed electrode feeding assembly (assembly) operates to introduce electrodes 3 into a process chamber as follows. Electrode 3 is first inserted into the assembly such that the electrode 3 extends completely through the assembly, (the inner 9 and outer 10 sealing mechanisms, the electrical contact assembly 5, and the penetration into the process chamber (not shown)), to the location within the process chamber desired by the user. The interior 9 and exterior 10 sealing mechanisms are then sealed about the electrode 3, forming an airtight seal separating the exterior atmosphere from the process chamber atmosphere and the electrode 3 may then be operated by delivering power to the electrode 3 through the electrical contact assembly 5. As the electrode 3 is consumed within the process chamber, the inner 9 and outer 10 sealing mechanisms are then made to work in concert to draw the electrode 3 into the process chamber while maintaining the integrity of the process chamber atmosphere. First, the exterior 10 sealing mechanism is relaxed, or unsealed, allowing it to move freely along the length of the electrode 3. While the outer 10 sealing mechanism is relaxed, the integrity of the atmosphere in the process chamber is maintained by the inner 9 sealing mechanism which remains sealed. Actuators 19 then expand the bellows 18, sliding the outer 10 sealing mechanism along the length of the electrode 3.

Actuators 19 for the prototype were linear actuators purchased from the Motion Systems Corp. of Eatontown, N.J. Actuators 19 are operated by a linear actuator motor 19*a* which drives a linear actuator gearbox 19*b*. The linear actuator gearbox 19*b* turns linear actuator screw 19d which is surrounded by the linear actuator sleeve 19*c*. The linear actuator screw 19*d* is affixed to the inner 9 internal sealing mechanism by mounting flange and brackets 20 and the outer 10 internal sealing mechanism is connected to the linear actuator sleeve 19*c* by one of the bladder assembly flanges 14. The linear actuator sleeve 19*c* is then moved as the linear actuator screw 19*d* is turned by the linear actuator motor 19*a* and linear actuator gearbox 19*b*.

During this process, an inert purge gas is introduced through the primary purge port 21, purging the region between the inner 9 and outer 10 sealing mechanisms and preventing any air from entering this region. The outer 10 sealing mechanism is then sealed about the electrode 3, forming an airtight seal and again insuring the integrity of the process chamber atmosphere. Protected from the outside atmosphere by the now sealed outer electrode 3, the inner 9 sealing mechanism is then relaxed, or unsealed, allowing it to move freely along the length of the electrode 3. The actuators 19 then contract the expandable section of the tube, forcing the electrode 3 through the electrical contact assembly 5, through the penetration in the process chamber, and into the process chamber to the location desired by the user. Once properly positioned, the inner 9 sealing mechanism again seals about the electrode 3, and the process is ready to be repeated. As will be recognized by those having skill in the art, each of the inner 9 and outer 10 internal sealing mechanisms, the actuators 19, and the primary 21 and secondary 8 purge ports may be controlled remotely by an electronic control system utilizing a central processing unit, thus automating electrode 3 feeding.

Figure 2:
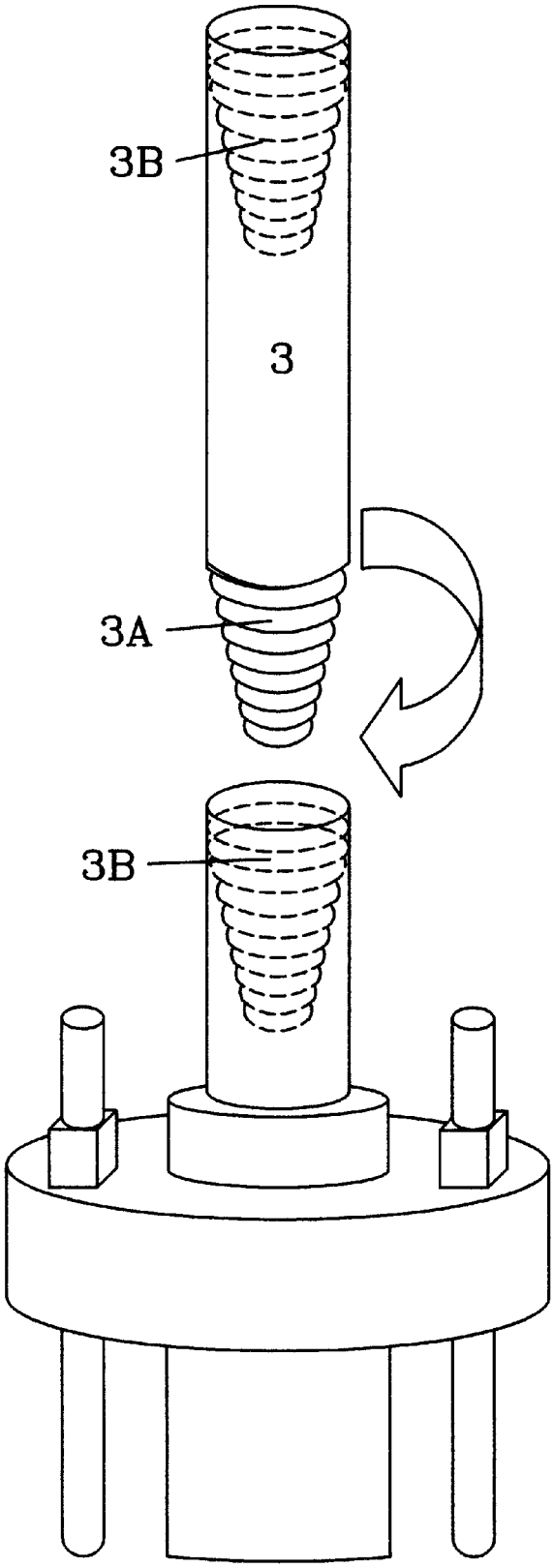
FIG. 2 is a view of an interconnecting section of electrode utilized in the operation of the present invention.

As shown in FIG. 2, electrode 3 may be lengthened to allow continuous feeding of the electrode. Electrodes 3 are configured with male 3A and female 3B ends allowing successive sections of electrode to be added as needed.

While a preferred embodiment of the present invention has been shown and described, it will be apparent to those skilled in the art that many changes and modifications may be made without departing from the invention in its broader aspects. For example, as will be apparent to those having skill in the art the present invention is useful in any application whereby an electrode is fed into a process chamber and it is desired that the atmosphere within the process chamber be kept separate from the surrounding atmosphere. As such, the scope of the present invention should in no way be limited to processes for the treatment or vitrification of wastes. The invention should be construed to encompass any process utilizing electrodes, including but not limited to waste processing, fuel conversion and production, ore refining, alloy manufacturing and energy recovery. The appended claims are therefore intended to cover all such changes and modifications as fall within the true spirit and scope of the invention.

I claim:

1. An apparatus for feeding electrodes into a process chamber which maintains the atmosphere within the process chamber as separate from the atmosphere surrounding the process chamber comprising:

a) an air-tight tube having at least two internal sealing mechanisms, an outer sealing mechanism and an inner sealing mechanism, said sealing mechanisms separated by an expandable section of the tube;

b) a penetration in the tube for the introduction of a purge gas in between the inner and outer sealing mechanisms; and c) an electrical contact for transmitting electrical power to the electrode.

2. The apparatus of claim 1 wherein the electrical contact is a water cooled collar located within the tube through which the electrode is inserted.

3. The apparatus of claim 1 wherein the electrical contact is isolated from the tube by isolators to prevent electrical power from the electrical contact from passing to the tube.

4. The apparatus of claim 1 wherein the internal sealing mechanisms comprise an inflatable bladder.

5. The apparatus of claim 1 further comprising an actuator attached to the tube at locations on either side of the expandable section of the tube.

* * * * *